United States Patent [19]

Martin

[11] Patent Number: 4,712,923

[45] Date of Patent: Dec. 15, 1987

[54] ELECTRONIC CALENDAR AND METHOD FOR RANDOMLY SELECTING AND DISPLAYING MESSAGES

[76] Inventor: Victor G. Martin, 513 Willowcrest Dr., Garland, (Dallas), Tex. 75040

[21] Appl. No.: 877,471

[22] Filed: Jun. 23, 1986

[51] Int. Cl.[4] ..... G04B 47/00; G04B 19/24; G04B 45/00

[52] U.S. Cl. ..... 368/10; 368/29; 368/41; 368/73; 368/82

[58] Field of Search ..... 368/10, 28–30, 368/63, 41–43, 72–74, 82–84, 239, 250–251; 364/569, 710; 40/107; 340/309.15, 309.4, 756, 789, 790, 798, 799

[56] References Cited

U.S. PATENT DOCUMENTS

| | | | |
|---|---|---|---|
| 3,999,050 | 12/1976 | Pitroda | 235/152 |
| 4,087,679 | 5/1978 | Samreus Nee Maymarev | 235/441 |
| 4,152,768 | 5/1979 | Kuriya | 364/705 |
| 4,193,255 | 3/1980 | Ebihara et al. | 368/34 |
| 4,274,146 | 6/1981 | Yanagawa | 364/705 |
| 4,373,822 | 7/1983 | Tkac | 368/256 |
| 4,385,291 | 5/1983 | Piguet | 340/712 |
| 4,493,043 | 1/1985 | Forbath | 364/569 |

*Primary Examiner*—Vit W. Miska

*Attorney, Agent, or Firm*—Richards, Harris, Medlock & Andrews

[57] ABSTRACT

An electronic calendar is provided for displaying time of the day, day of the week, and month-date-year with automatic adjustments for leap years and changes to and from standard and daylight times. The electronic calendar also displays preprogrammed and user programmed information such as holidays, holy days, birthdays, anniversaries, appointments, horoscopes, and other messages. In addition, the electronic calendar incorporates a method for randomly selecting and displaying programmed messages, such as advertisements and safety slogans, at recurring times to reinforce the user's memory of such messages.

17 Claims, 4 Drawing Figures

ELECTRONIC CALENDAR AND METHOD FOR RANDOMLY SELECTING AND DISPLAYING MESSAGES

TECHNICAL FIELD

This invention relates to electronic information display devices and, in particular, to an electronic calendar which displays information, including time, day, date, and programmed messages, and which incorporates a method for randomly selecting and displaying designated messages.

BACKGROUND OF THE INVENTION

Recent advances in the fields of semiconductor technology and liquid crystal displays (LCDs) have made it possible to produce a variety of electronic devices which have not been technically or economically feasible for use by consumers in the past. In particular, electronic solid state products such as electronic calculators, digital watches, and digital clock radios are now commonplace.

Electronic clocks and watches have become increasingly sophisticated with advances in technology. For example, electronic diaries now combine the functions of a clock, a calendar, and an appointment schedule. However, consumers desire even greater memory and display capacity in an electronic calendar to realize greater flexibility and convenience in keeping up with important dates, appointments, and deadlines.

Thus, a need has arisen for an electronic calendar which automatically corrects for leap years and adjusts for changes between standard and daylight times. An electronic calendar is desired for display of preprogrammed and user programmed information such as holidays, holy days, birthdays, anniversaries, appointments, and other messages. Further, a need exists for an electronic calendar which displays and audibly signals randomly selected programmed messages, such as advertisements and safety slogans, at recurring times so as to reinforce the user's memory of such messages.

SUMMARY OF THE INVENTION

The present invention is an electronic calendar having an LCD alphanumeric display system. The electronic calendar includes an oscillator which provides reference signals to a real time clock which generates time data for the calendar. The calendar selectively displays day of week, time in hours-minutes-seconds, and date as month-date-year. The calendar is programmed to automatically adjust for leap years and for changes between standard and daylight times.

The electronic calendar includes a keyboard having function keys and alphanumeric keys. The user initiates the calendar by operating the keyboard to set the time, day, and date. In addition, the user may program messages associated with each date of the year. For example, messages may be event reminders for birthdays, anniversaries, or appointments. The calendar may be programmed to display each message on the designated date as well as several days in advance.

The electronic calendar also includes preprogrammed messages such as holiday reminders. The calendar also may include a program to calculate the date of Easter each year. Other messages, such as advertisements and safety slogans, may be programmed to be randomly selected and displayed at recurring times to reinforce the user's memory of such messages without them becoming unduly repetitive. An audible tone may be provided to alert the user each time a message is displayed by the calendar.

BRIEF DESCRIPTION OF THE DRAWINGS

For a more complete understanding of the present invention and for further advantages thereof, reference is now made to the following Detailed Description of the Preferred Embodiment taken in conjunction with the accompanying Drawings, in which.

DETAILED DESCRIPTION OF THE PREFERRED EMBODIMENT

Figure 1:
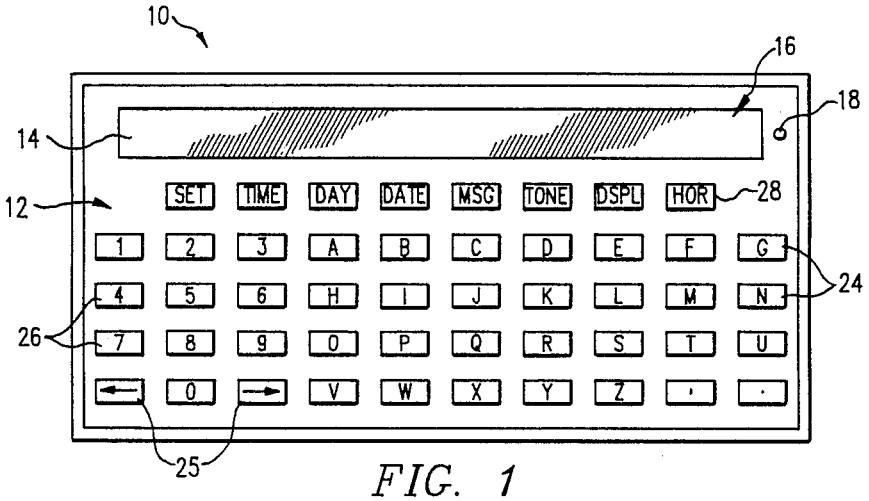
FIG. 1 is a pictorial representation of one embodiment of the electronic calendar of the present invention.

Referring to FIG. 1, there is depicted in pictorial illustration one embodiment of an electronic calendar according to the present invention. Calendar 10 includes an alphanumeric data input keyboard 12 and an alphanumeric display 14 for visually representing stored data. Calendar 10 may include ancillary components such as electroluminescent back light 16 and audible output transducer 18. As hereinafter described, the calendar depicted in FIG. 1 can obtain input from keyboard 12 or from stored inputs for display on display screen 14. In one embodiment, display 14 enables 40 characters to be shown. Keyboard 12 includes alphabetic input keys 24 for use in defining a message and numeric keys 26 for use in inputting time and calendar data. Function keys 28 enable electronic calendar 10 to accept data and to display data.

In one embodiment of calendar 10, function keys 28 are provided as follows:

| FUNCTION | DESCRIPTION |
|---|---|
| SET | Enables calendar 10 to accept designated input data from keyboard 12. |
| TIME | Initializes time during power up; sets time for message display. |
| DAY | Initializes day of week to correspond with date. |
| DATE | Initializes calendar to present date; sets date for message display. |
| MSG | Enables alphanumeric message data to be accepted; enables stored messages to be recalled for displaying. |
| TONE | Enables or disables electronic tone. |
| DSPL | Enables or disables electroluminescent back-light. |
| HOR | Enables horoscope message data display. |

It will be apparent from calendar 10, as shown in FIG. 1, that various time and message inputs may be provided to calendar 10 and displayed either immediately or at a preselected time.

Figure 2:
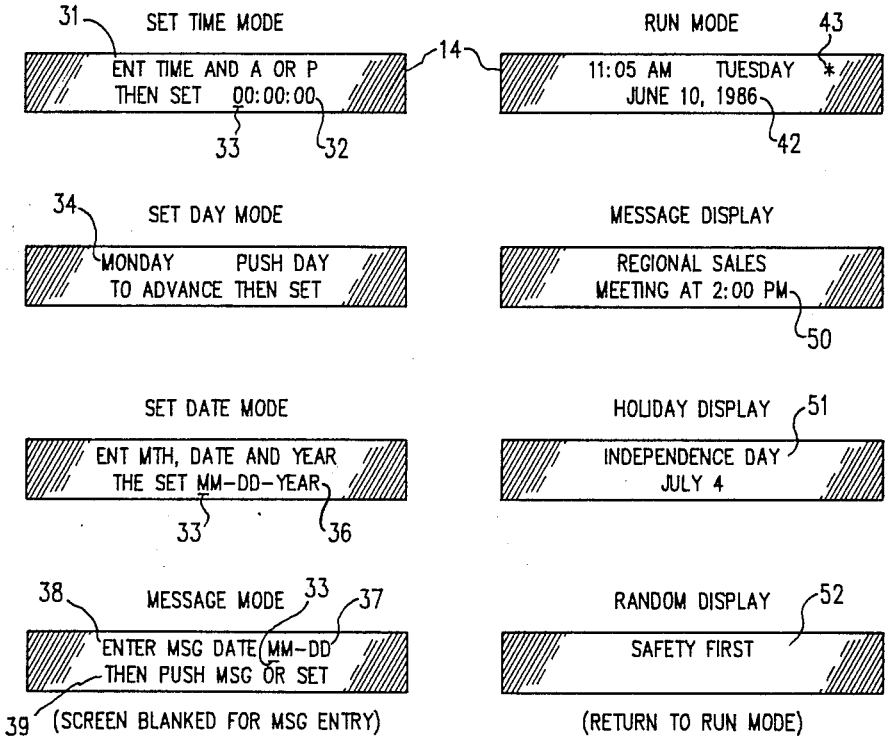
FIG. 2 is a schematic illustration of representative displays of the set, run, and display modes of the electronic calendar of the present invention.

Referring to FIG. 2, various display characteristics of calendar 10 are illustrated. When the SET key is depressed to place calendar 10 in a data input mode, data is accepted according to the function key depressed. When the TIME key is depressed, time data display 32 accepts minute, hour, and second input data with an AM/PM designation. In a preferred embodiment, a cursor 33 appears beneath the data box accepting an input designation. Depressing the DAY function key enables the keyboard 12 to input the day of the week 34. Next, the DATE function key displays data blocks for month, day, and year display 36, with day display 34 corresponding to the month and day selection. Finally, the MSG function key enables up to 40 characters of alphabetical and numerical inputs associated with a selected message date 37 to be accepted for storage and display.

After data has been input to calendar 10, a RUN mode is initiated. Calendar 10 will then display the TIME, DAY, MONTH, DATE AND YEAR 42. It will be appreciated that calendar 10 has accepted date information 36 in numerical form and displays calendar information 42 in conventional alphanumeric form for ready visualization. Calendar 10 may also display a preprogrammed message corresponding to a holiday 51, holy day, or commemorative event seven (7) days ahead of the designated date. The calendar may also be programmed to compute the date of Easter each year, to adjust for leap years, and to correct the time for changes to and from standard and daylight times. As hereinafter described, each message displayed may be accompanied by an audible tone to attract attention to the announcement. The symbol *, referenced by numeral 43, indicates that the audible tone is enabled so that a tone is emitted when calendar 10 displays a message.

Calendar 10 also performs calendar functions of reminding the viewer of scheduled events. In one embodiment, three determinable message modes may be selected. In one message mode a reminder message 50 is input to appear on a selected date and month to remind the viewer of an event to occur. The message display may occur on the date of the event or may occur within a selected time prior to the actual event. In a second message mode, annual events such as birthdays and anniversaries may be entered. A reminder message will then be displayed on a selected date on an annual basis without the need to reenter the message. In a third message mode, preprogrammed or user input messages 52 are designated to be randomly selected and displayed at recurring times. Messages thus selected and displayed are reinforced in the user's memory without becoming unduly repetitive.

Stored messages may be recalled for display by depressing the MSG function switch. Whenever a stored message is encountered as the date advances, the stored message will be displayed. All of the messages which occur on a displayed date will be shown when the MSG function key is depressed to interrogate calendar 10.

Figure 3:
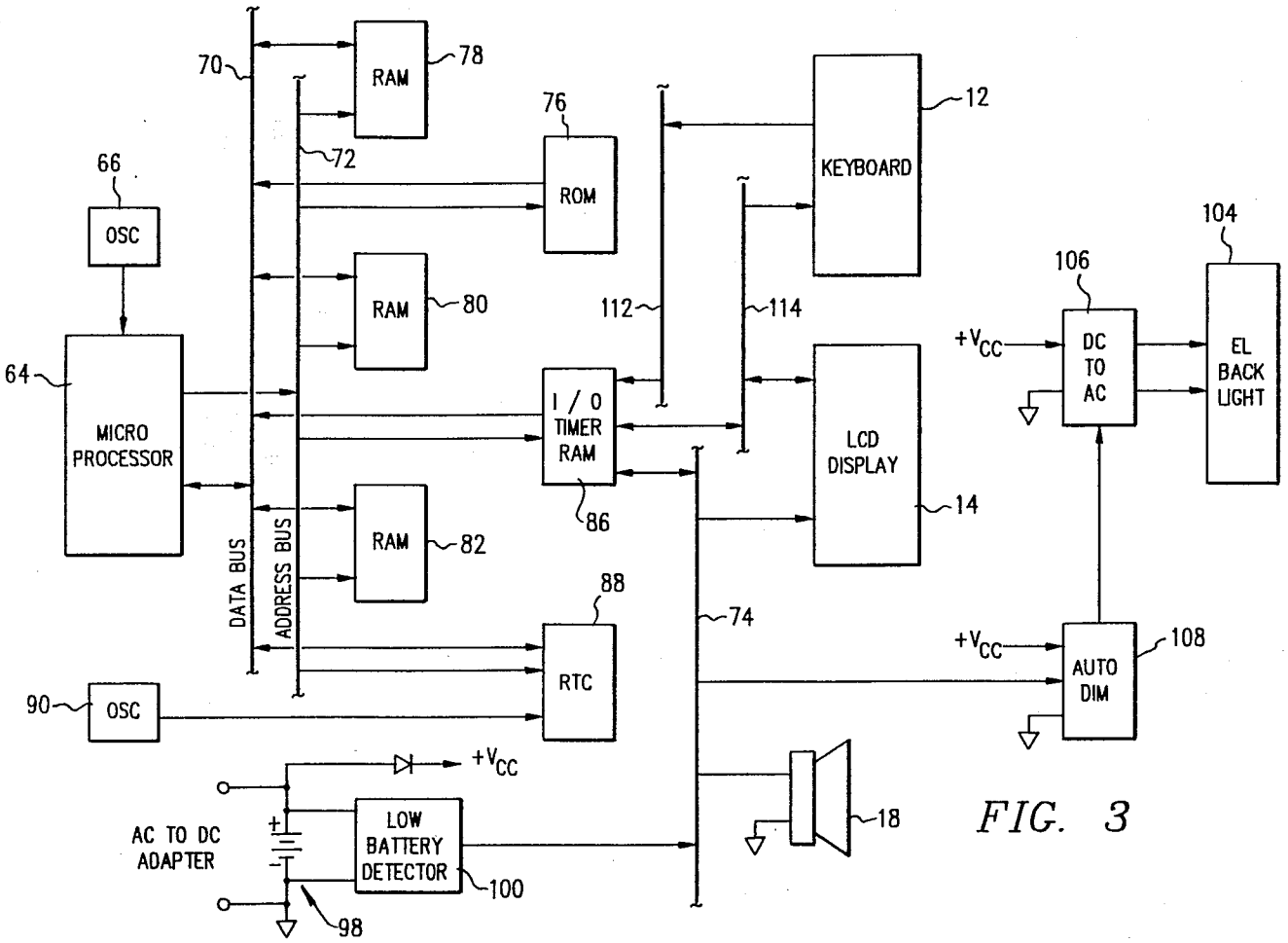
FIG. 3 is a block diagram of the electronic components of the present invention.

Referring now to FIG. 3, there is shown a schematic representation in block diagram form of one embodiment of calendar 10. Keyboard 12 provides input data through input/output timer 86. Data from keyboard 12 is provided along bus 112 and presented through timer 86 to data bus 70. Microprocessor 64 forms the basic control unit for calendar 10 and is clocked through its operating sequence by oscillator 66. Microprocessor 64 determines the nature of data appearing on data bus 70 and directs address bus 72 to the proper operating unit.

The operating unit is controlled by microprocessor 64, including a first storage means 76, which may be a ROM unit. First storage means 76 generally stores messages which are fixed within the machine. Second storage means 78 is provided for data which is input through keyboard 12 and which can be altered by means of keyboard 12. Third and fourth storage means 80 and 82 may be provided and addressed through associated function keys 28 of keyboard 12. Third and fourth storage means 80 and 82 may also be RAM-type devices to enable data to be stored and subsequently recalled. Input/output timer 86 is also used to sequence data from first, second, third, and fourth storage means 76, 78, 80, and 82 through microprocessor 64 and in communication with keyboard 12 and display 14. Finally, a real time clock 88, clocked by oscillator 90, is provided to generate time, day, month, date and year data for display. Real time clock 88 may include first and second clock means for generating time of day and calendar date.

Transducer 18 is provided to obtain an audible indication that a selected message is being displayed. Bus 74 is provided to enable both display 14 and transducer 18. The output signal from timer 86 may include a first portion to activate display 14 and a second portion to generate an audible output from transducer 18. Transducer 18 may be formed from a piezoelectric material.

Ancillary circuits include power supply 98 and an associated logic circuit 100 for detecting a low battery condition. As shown in FIG. 3, a low battery condition may further serve to activate transducer 18 to alert the calendar user. Display 14 may be formed of any conventional display design, such as liquid crystal, vacuum fluorescent, or a direct current plasma display, although a liquid crystal display may be preferred to minimize power consumption. A back light 104 may be provided for display presentation and lower light conditions. The back light 104 may be an electroluminescent light, which may be activated by direct current to alternating current converter 106. For further convenience, light sensor circuit 108 may be provided to control the output from back light 104.

Referring now to FIGS. 1, 2, and 3, the operation of the calendar 10 will be described. Referring first to setting and initializing calendar 10, the TIME function may be selected to put the calendar in the set time mode. The message ENT TIME AND A OR P THEN SET 31 will be displayed on two rows of visual display 14 and the time set display 32 will provide a cursor 33 or a blinking indication for the input data being accepted. A progressive operation of the TIME key or direct numerical input data can be used to set the time. The hours, minutes and seconds are set in this manner. Preferably, the respective time inputs may be rolled over without affecting the higher level inputs.

The DAY key is used to set the name of the day 34 corresponding to the calendar date. Calendar 10 may accept an alphabetic input to spell the name of the day or may be programmed to sequentially display the days of the week until the desired day name is reached.

The DATE is similarly set by depressing the SET key in connection with the DATE key. A cursor 33 or blinking indicator designates the input data to be supplied. Numerical data representing the date may be input by sequential operations of a function key or may be provided by direct input from the numerical keyboard.

Depressing the MSG key in the run mode will advance the display to the message mode, displaying ENTER MSG DATE MM-DD 38 on the top row of the display and THEN PUSH MSG OR SET 39 on the bottom row of the display. A cursor 33 will indicate the position of the character being accepted and data may be entered from the keyboard for display in consecutive positions in conventional left to right arrangement. If more than 40 characters are entered, the excess characters over 40 will be lost. The cursor 33 may be moved to a desired location by pressing the direction keys 25. The inputted message is stored and the calendar 10 is returned to the run mode by depressing the SET key.

Depressing the MSG key for birthday and anniversary presentations will cause the input data to be stored in a location which returns the stored data for annual presentation. Data stored in these locations will be displayed within a time interval determined by the calendar user, by inputting a display month and date 37 prior to the message input setting. Stored messages may be interrogated by depressing the MSG key inputting the desired month and date and depressing the MSG key again.

Referring again to FIG. 3, RAM storage units 78, 80, and 82 are depicted for accepting data from keyboard 12. As explained above, stored data may be representative of a single event whereby microprocessor 64 and input/output timer 86 will cause the display to be activated with the message every 15 minutes. Thereafter, the message will be cleared from the display unit. Yet another storage unit may be provided for annual events whereby the message will be displayed and returned for storage and subsequent display.

In accordance with a particular feature of the present invention, fixed storage ROM 76 may be provided with messages which cannot be altered. For example, electronic calendar 10 may be distributed pursuant to a commercial program with advertising messages or safety slogans 52 placed within ROM 76. Designated messages in ROM 76 may be displayed contemporaneously with an audible signal from transducer 18 to attract attention to the display. In one embodiment, the display of a designated message accompanies the display of a stored message to further increase visual perception.

Figure 4:
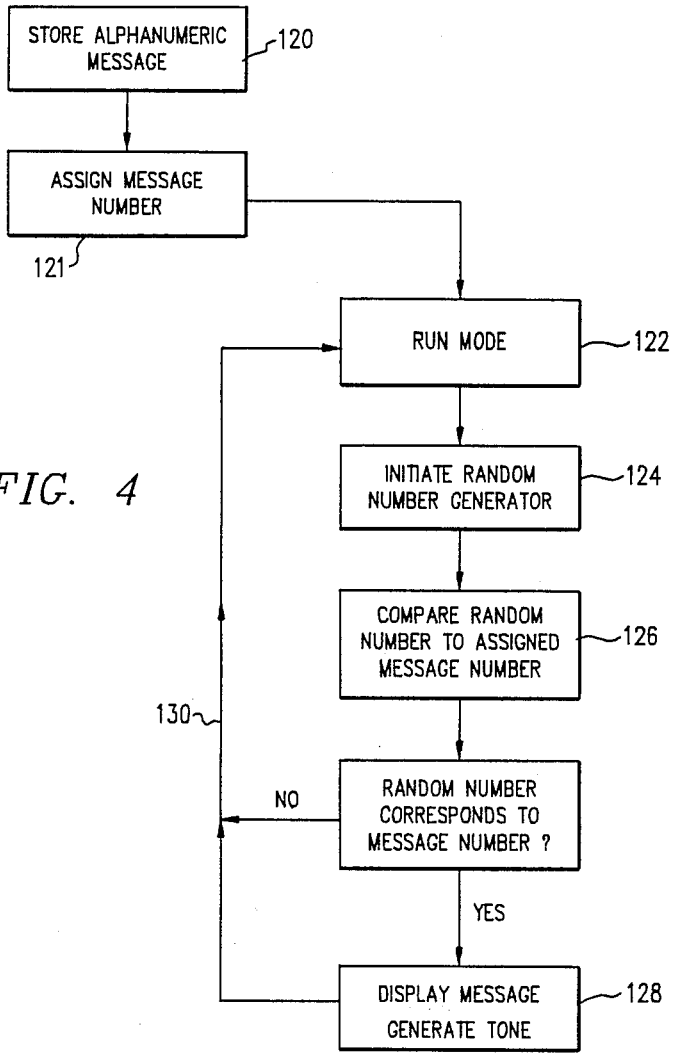
FIG. 4 is a logic diagram of the method of the present invention of randomly selecting and displaying designated messages.

In order to prevent the recurring designated messages from being unduly repetitious, microprocessor 64 may be programmed to randomly select and display the designated messages. Further, ROM 76 may contain a plurality of stored messages and microprocessor 64 may select one of a plurality of stored messages for presentation at the occurrence of a random event. As illustrated in the logic flow diagram of FIG. 4, designated alphanumeric messages are stored 120 with an assigned message number 121. In the run mode 122, microprocessor 64 initiates a random number generator 124 at preselected times or predetermined time intervals. Microprocessor 64 compares the generated random number 126 with the assigned message numbers 120 previously stored. If the random number corresponds to any assigned message number, the message associated with that number is displayed 128 on screen 14 and a tone is emitted by transducer 18. The message remains on display screen 14 for a predetermined time and then the calendar returns 130 to the run mode 122. If the generated random number does not correspond to any of the assigned message numbers, the calendar returns 130 to the run mode 122 without displaying a message or emitting a tone.

It is apparent that the present invention is one well adapted to attain all of the features hereinabove set forth together with other features which will become obvious from the description of the apparatus itself. It will be understood that certain combinations and subcombinations are of utility and may be obtained without reference to other features and subcombinations. It is intended that the present invention encompass changes and modifications to the foregoing preferred embodiment as fall within the scope of the appended claims.

I claim:

1. An electronic calendar, comprising:

a keyboard having function keys and alphanumeric keys for entering time, date, and message data;

means connected to said keyboard for storing and processing said time, date, and message data;

display means connected to said keyboard and said storing and processing means for displaying said time, date, and message data; and said storing and processing means including means for randomly selecting designated message data for display at recurring times.

2. The electronic calendar of claim 1, wherein said storing and processing means comprises:

a microprocessor;

a read only memory, a random access memory, and a real time clock all connected to said microprocessor; and an input/output timer connected between said microprocessor and said keyboard and said display means.

3. The electronic calendar of claim 2, further comprising an oscillator for providing reference signals to said real time clock.

4. The electronic calendar of claim 1, further comprising transducer means for providing an audible tone when said message data is displayed.

5. The electronic calendar of claim 1, wherein said message data includes event reminders of holidays, holy days, birthdays, anniversaries, and appointments.

6. The electronic calendar of claim 5, wherein said event reminders are displayed a selected number of days in advance of actual dates of the events.

7. The electronic calendar of claim 1, wherein said message data includes horoscope information.

8. The electronic calendar of claim 1, wherein said designated message data includes information such as advertisements and safety slogans.

9. In an electronic calendar comprising a keyboard for entering alphanumeric data, means for storing and processing said data, and means for displaying said data, the improvement comprising means for randomly selecting designated data for display at recurring times.

10. The electronic calendar of claim 9, further comprising transducer means for providing an audible tone when said designated data is displayed.

11. The electronic calendar of claim 9, wherein said designated data includes information such as advertisements and safety slogans.

12. The electronic calendar of claim 9, wherein said alphanumeric data includes event reminders of holidays, holy days, birthdays, anniversaries, and appointments.

13. The electronic calendar of claim 12, wherein said event reminders are displayed a selected number of days in advance of actual dates of the events.

14. The electronic calendar of claim 9, wherein said alphanumeric data includes horoscope information.

15. A method for randomly selecting and displaying alphanumeric data at recurring times, comprising the steps of:

storing an alphanumeric data group in a microprocessor system having a means for displaying said data group;

assigning said data group a message number;

generating a random number at preselected time intervals;

comparing said generated random number with said assigned message number; and displaying said alphanumeric data group if said generated random number corresponds to said assigned message number.

16. A method for randomly selecting and displaying alphanumeric data messages in an electronic calendar having means for storing, processing, and displaying said messages, comprising the steps of:

storing said alphanumeric data message;

assigning said message a message number;

generating a random number at preselected time intervals;

comparing said generated random number with said assigned message number;

displaying said message if said generated random number corresponds to said assigned message number.

17. The method of claim 16, further comprising the step of providing an audible tone to signal the display of said message.

* * * * *